United States Patent [19]

Stewart

[11] 4,109,388

[45] Aug. 29, 1978

[54] NEEDLE INDICATOR FOR RAIL LINER

[75] Inventor: John K. Stewart, Columbia, S.C.

[73] Assignee: Canron, Inc., New York, N.Y.

[21] Appl. No.: 739,446

[22] Filed: Nov. 1, 1976

[51] Int. Cl.[2] ..... E01D 29/04

[52] U.S. Cl. ..... 33/287; 33/1 Q; 33/146; 33/338; 104/7 R

[58] Field of Search ..... 104/7 B, 7 R, 8; 33/1 Q, 84, 144, 146, 287, 286, 338

[56] References Cited

U.S. PATENT DOCUMENTS

| | | | |
|---|---|---|---|
| 2,962,979 | 12/1960 | McCormick | 33/287 X |
| 3,557,459 | 1/1971 | Plasser et al. | 33/144 |
| 3,604,117 | 9/1971 | Beckmann | 33/287 |

*Primary Examiner*—William D. Martin, Jr.

[57] ABSTRACT

An indicator mechanism for an apparatus for correcting the existing grade and horizontal alignment of railroad track in accordance with a wire reference system. The mechanism includes frame means, the position of which in use is referenced to the existing position of an adjacent section of the railroad track. Pivot means are mounted on the frame means and a needle indicator is mounted on the pivot means so as to pivot about a horizontal axis generally parallel to a reference wire. A second indicator is mounted on the needle indicator for generally vertical, sliding movement thereon. A first index is arranged on the frame means to indicate in combination with the needle indicator the existing horizontal alignment of the adjacent section with reference to the reference wire. A second index in the form of a scale is arranged on the needle indicator and it indicates in combination with the second indicator the existing grade of the adjacent section of a track again with reference to the reference wire. During use of the mechanism, the positions of the needle indicator and the second indicator are adjusted by the reference wire in contact with the needle indicator and the second indicator. Preferably, the reference wire extends through an elongated slot in the bottom portion of the needle indicator, this slow extending vertically when the needle indicator is in a vertical position.

11 Claims, 4 Drawing Figures

NEEDLE INDICATOR FOR RAIL LINER

BACKGROUND OF THE INVENTION

The present invention relates to apparatus for correcting both the existing grade and the horizontal alignment of railroad track in accordance with a wire reference system and, in particular, to a mechanism for such an apparatus capable of indicating to an operator both the grade and horizontal alignment of the track being or to be corrected.

DESCRIPTION OF THE PRIOR ART

It is well known to correct the horizontal alignment of railroad track with the reference point for the aligning machine being provided by one or two tensioned wires which extend generally parallel to the rails for some distance and are referenced to the existing rails. Examples of known arrangements for aligning track in this manner are shown and described in U.S. Pat. Nos. 3,050,015 dated Aug. 21, 1962, and 3,165,838 dated Jan. 19, 1965.

It is also known to correct the grade or level of railroad track with the reference point or plane for the levelling machine, usually one able to tamp the ballast, also being provided by one or two tensioned wires arranged generally parallel to the rails, taken in a vertical plane extending longitudinally of the rails. These levelling wires are also referenced to the existing rails. Examples of known arrangements for levelling track with the use of wires are described in U.S. Pat. Nos. 3,119,346 dated Jan. 28, 1964 and 3,433,175 dated Mar. 18, 1969.

Also British Pat. No. 1,204,558 dated Dec. 20, 1968 describes a system for observing the horizontal and vertical alignment of a railroad track that employs a single reference wire in combination with horizontal and vertical scale means and an optical arrangement to project a picture of the instantaneous horizontal and vertical alignment of said track. The optical arrangement includes a number of precisely arranged mirrors and lenses. In this system the same wire is used to provide an indication of both the vertical and horizontal alignment of the track whose position is to be corrected. The described system has several disadvantages including its expense and the skill required to construct it. Such a system could also be difficult to maintain and repair and to adjust to local conditions.

Accordingly it is an object of the present invention to provide an indicator mechanism which is practical and inexpensive, can be used in conjunction with an apparatus for correcting the existing grade and horizontal alignment of railroad track, and indicates by means of only a single reference wire both the existing grade and horizontal alignment of the track.

It is a further object to provide an indicator mechanism having both a needle indicator and a second indicator capable of indicating on suitable scales both the existing grade and horizontal alignment of an adjacent section of track.

SUMMARY OF THE INVENTION

Accordingly, the device of the invention consists of an indicator mechanism for an apparatus for correcting the grade and horizontal alignment of railroad track in accordance with a wire reference system having a reference wire tautly extending along said track, said mechanism comprising frame means, the position of said frame means in use being referenced to the existing position of an adjacent section of the railroad track, pivot means mounted on said frame means, a needle indicator mounted on said pivot means to pivot about a horizontal axis generally parallel to the reference wire, a second indicator mounted on said needle indicator for generally vertical, sliding movement thereon, first index means arranged on said frame means to indicate in combination with said needle indicator the existing horizontal alignment of said adjacent section with reference to said reference wire, second index means to indicate in combination with said second indicator the existing grade of said adjacent section with reference to said reference wire wherein, during use of such mechanism, the positions of said needle indicator and second indicator are adjusted by said reference wire in contact with said needle indicator and second indicator.

The reference wire preferably extends through an elongated slot in the bottom portion of the needle indicator, this slot extending vertically when the needle indicator is in a vertical position. In a preferred embodiment means are provided to compensate for variations in system geometry as a result of curved track.

Other features and advantages will be evident from the following detailed description taken in conjunction with the accompanying drawings.

BRIEF DESCRIPTION OF THE DRAWINGS

The following is a description by way of example of a preferred embodiment of the invention, reference being had to the accompanying drawings in which.

DETAILED DESCRIPTION OF PREFERRED EMBODIMENT

Figure 1:
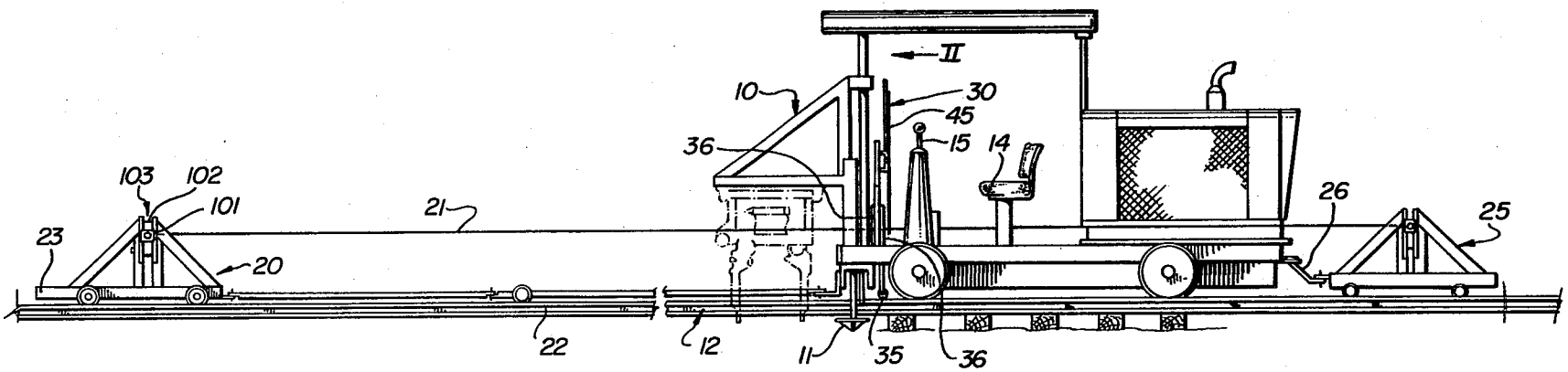
FIG. 1 is a side elevation of an apparatus for correcting existing grade and horizontal alignment of railroad track in accordance with a wire reference system.

In FIG. 1, there is shown a tamping machine 10 of known configuration equipped with conventional hydraulic track lifting and lining jacks 11 for correcting both the existing grade and the horizontal alignment of a section of railroad track 12. The operator of the machine 10 sits on the seat 14 where he is in a position to operate the hydraulic controls for the machine, located at 15.

Attached to the front of the machine is a conventional lightweight taut wire support system 20 for a single taut reference wire 21 which extends generally parallel to the two rails 22 and 22' of the track 12 and a short distance to the outside of one of these rails. At the front end of the support system 20 is a lead car 23 which is provided with means for holding the front end of the reference wire 21 and with conventional means for adjusting the position of the front end of the wire either vertically or horizontally as required. For example, the wire 21 can be supported at the end of a horizontally extending bar 101. The inner end of this bar can be rigidly connected to a vertically adjustable support member 102 which is mounted in vertical slot 103. The horizontal bar 101 can be a telescopic configuration in order to permit the horizontal adjustment. The car 23 is biased, as is usual, against one rail (the line rail) by means of a spring biased wheel or other means. The rear end of the reference wire 21 is adjustably supported in a manner similar to the front end of the wire on a support car 25 connected to the back of the track working machine 10 by means of connecting links 26. The rear support car 25 can also be provided with suitable conventional wire tensioning means (not shown) in order that the proper tension will be applied to the wire 21. The rear car 25 is also conventionally biased against the line rail. Thus the support system and particularly the reference wire 21 are maintained in a fixed, known position relative to the grade rail.

Figure 2:
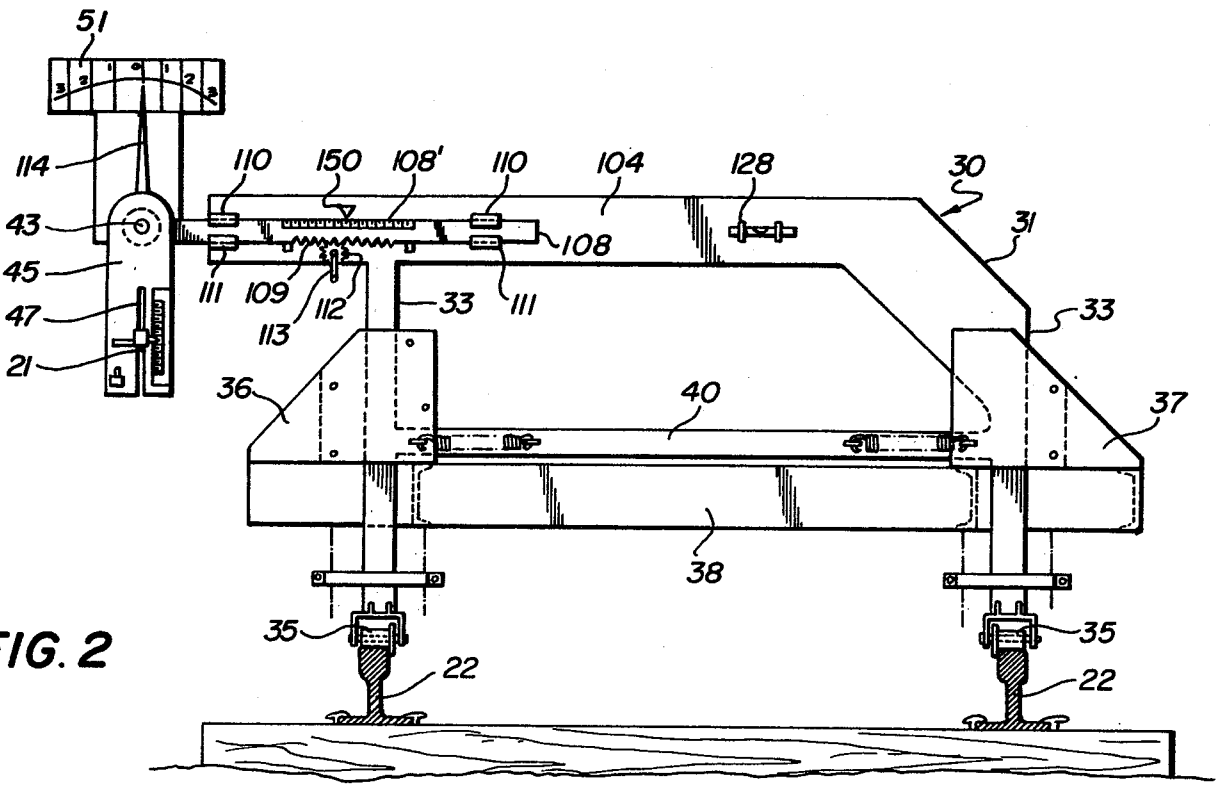
FIG. 2 is a detail in elevation of the indicator mechanism and the support therefor looking in the direction of the arrow II of FIG. 1.

In order to indicate to the machine operator what the existing position of the track being aligned by the machine is relative to the reference wire 21, the present invention provides an indicator mechanism 30, best shown in FIG. 2 of the drawings.

The indicator mechanism 30 for use with a wire reference has a reference frame 31 comprising a horizontal member 104 and two legs 33 each terminating in a rail engaging wheel 35. The frame, in operation, rests on the rails sandwiched between front and rear pairs of guide plates 36, 37 (the rear plate of each pair is seen in FIG. 2) mounted on the machine frame 38. The reference frame 31 is pushed by the machine 10 and is biased against the guide rail in conventional fashion. The frame 31 can, if desired, be lifted by the machine and carried thereon for track travel. The cross brace 40 extends between the legs 33 and provides increased lateral support for the legs to prevent any bending or twisting thereof.

The horizontal member 104 slideably supports a horizontally extending bar 108 having a series of teeth 109 on the bottom edge thereof. Two L-shaped brackets 110 are rigidly connected to the rear surface of the member 104 and support the upper edge of the bar 108. Similarly two L-shaped brackets 111 are mounted to the intermediate member 104 to support the bottom edge of the bar 108. The height of the bar 108 corresponds closely to the distance between the inner surfaces of the horizontal legs of the brackets 110 and 111 which are located opposite each other. Thus the bar 108 is free to slide horizontally in the guideways provided by the brackets 110 and 111. The teeth on the bar 108 are engaged by a pinion 112 rotatably mounted on the member 104. The pinion can be rotated by means of a small crank 113. In this way, the horizontal position of the bar 108 with respect to the reference frame 31 can be adjusted by the operator of the machine 10. The bar 108 can be equipped with a scale 108' and the member 104 can have an indicator 150 fixed thereon to permit adjustments for track curvature. The position of scale 51 can be adjusted relative to bar 108 so that at desired curvature a "zero" reading will result. This could be also used as an immediate indication of deviations.

The outermost end of the bar 108 carries a pivot means comprising a suitable bearing 43 on which a metal needle indicator 45 is mounted. The needle indicator 45 is mounted at the side of the machine where the reference wire is located and is provided with a wire receiving slot 47 at its lower end, this slot being just wide enough to accommodate the wire 21. Thus relative movement of the wire 21 and reference frame 31 in the direction extending transversely of the track causes the needle indicator 45 to pivot clockwise or counterclockwise about its pivot bearing 43 on the bar 108. Bar 108 extends outwardly and upwardly to a position generally above the needle indicator 45 and the pivot bearing 43 to carry scale 51 which forms a first index means. The position of the upper point 114 relative to the scale 51 indicates the existing horizontal alignment of the adjacent rail 22' of the track with reference to the reference wire 21.

Figure 3:
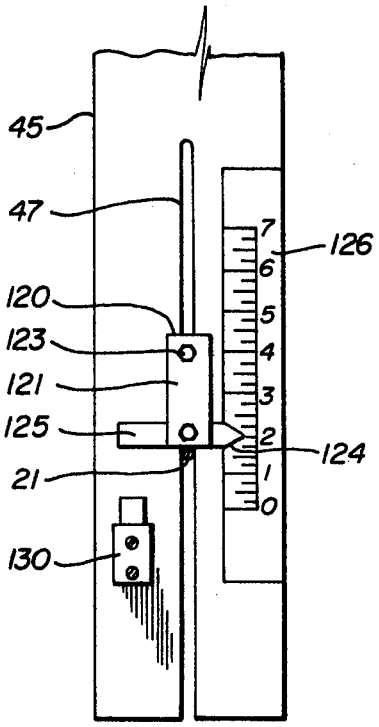
FIG. 3 is a detail in elevation of the lower portion of the needle indicator.
Figure 4:
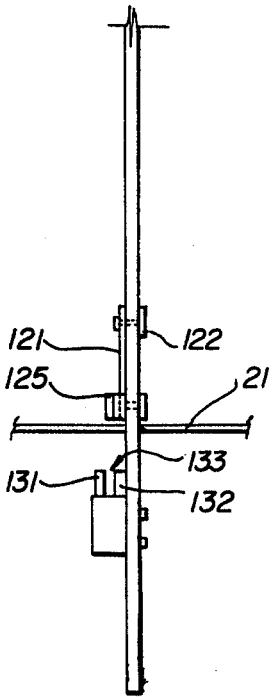
FIG. 4 is a side view of the lower portion of the indicator shown in FIG. 3.

The lower portion of the needle indicator 45 is shown in detail in FIGS. 3 and 4. A relatively small, second indicator 120 is mounted for generally vertical, sliding movement in the elongated slot 47. This indicator 120 has a small rectangular plate 121 adjacent the rearwardly facing surface of the the needle indicator and small, flat discs 122 adjacent the forward-facing surface of the needle indicator. The diameter of the discs 122 and the width of the plate 121 exceed the width of the slot 47 and the discs are rigidly connected to the plate 121 by means of two bolts or rivets 123. The distance between the inner surfaces of the plate 121 and discs 122 is just slightly greater than the thickness of the lower portion of the needle indicator so that the indicator 120 will have no difficulty in sliding up and down in the slot. The second indicator 120 is provided with a pointer 124 which is rigidly connected to one of the long side edges of the plate 121. A small shadow board or cut off tab 125 is mounted opposite the pointer 124 on the plate 121. The manner of operation and function of this shadow board is explained hereinafter.

A second index means or scale 126 is scribed on the lower portion of the needle indicator on the rearwardly facing surface. This scale 126 extends along one side of the slot 47 and, in the preferred embodiment shown, it is marked off in inches from a 0 reading at the bottom to a 7 inch reading at the top. The second indicator 120 when moved up and down by the reference wire 21 will indicate various readings on the scale by means of its pointer 124. The scale 126 together with the pointer 124 indicate to the operator of the machine the existing grade of the adjacent section of track with reference to the reference wire 21.

In operation on tangent track, with the wire 21 extending well in front of and somewhat behind the machine 10 to provide a long line reference for track corrections, left right alignment discrepancies in the track, at a section thereof being measured by indicator means of scale 51 in conjunction with scale 108', show up in the clockwise or counterclockwise displacement of the needle indicator 45, in particular its upper point 114, against the calibrated scale 51 and surface discrepancies are measured by reading the position of the pointer 124 on the scale or index means 126 on the lower portion of the needle indicator. If desired, a cross level bubble device 128 can be mounted on the member 104 in order to indicate to the operator whether or not the track is a super elevated section of curved track. On straight or tangent track, this cross level bubble will show that the track is not super elevated and therefore no adjustment for super elevation need be made by the operator the the indicator mechanism.

Before the indicator mechanism of the present invention is able to measure track discrepancies in a curve, it is necessary to compensate for the relative change in the position of the wire. One means for accomplishing this is to turn the crank 113 which moves the bar 108 to adjust the position of the pivot bearing at 43. If the curve is to the left looking in the forward direction of the machine, the bar 108 will be moved outwardly while if the curve is to the right, the bar would be moved inwardly towards the transverse center of the machine and the frame 31. The adjustment of the pivot bearing 43 horizontally will of course only compensate for the relative horizontal change in the position of the wire 21. With the proper adjustment of the horizontal position of the pivot bearing 43, the operator can read, even in curves, the alignment condition of the track by the position of the upper point 114 against the calibrated scale 51, the shape of which has already been compensated, when drawn for this change in wire position.

For a curve alignment operation, the operator may, as is known in the art, first pass the machine 10 through the curve and draw a graph thereof. The desired curve form may then be superimposed by drawing over the graph. Thereafter the operator may pass the machine through the curve once again, aligning the track to the desired corrected curve.

Returning now to FIGS. 3 and 4, a photocell assembly 130 is mounted on the lower portion of the needle indicator 45. As shown, the assembly is on the rearwardly facing surface of the indicator and is mounted generally opposite the 0 reading on the scale 126. This assembly can consist of a light beam emitter 131 and a receiver 132. The emitter and receiver are separated by a small space 133 which is just wide enough to accommodate the aforementioned shadow board 125 mounted on the indicator 120. The shadow board 125 is spaced a short distance outwardly from the needle indicator 45 in order to accommodate the receiver 132 when the indicator 120 is in its lowermost position. Suitable electric wiring extends along the adjustable bar 108 and down the needle indicator 45 to the photocell assembly in order to provide the necessary power to this assembly. In a well-known manner, light is normally transmitted from the emitter 131 to the receiver 132 so that there is an open electrical circuit. However, when the indicator 120 is in its lowermost position, i.e. a 0 reading, the shadow board interrupts the transmission of light so that the electrical circuit is broken. This in turn could cause a signal light to come on in front of the machine operator or cause an electric valve to interrupt oilflow to the lifting cylinder, thus terminating upward movement. It will be obvious to those skilled in the art that the photocell assembly 130 could be used to indicate a variety of conditions depending upon its particular position on the needle indicator or its position relative to the scale 126.

It will be obvious to those skilled in the art that a photocell assembly similar to assembly 130 could be arranged adjacent to or on the calibrated scale 51. For example, this assembly could be mounted above the scale 51 directly over the 0 point on the scale and a small shadow board could be on the upper end of the needle indicator. In this case, the needle indicator could be quite narrow and of uniform width in order to extend completely across the scale 51 and to support the sahdow board in the region of the photocell assembly. This photocell assembly could also trigger an indicator light or operate an appropriate valve to indicate that the track is in correct horizontal alignment, and/or stop-lining actuation at this point.

What is claimed is:

1. An indicator mechanism for an apparatus for correcting the grade and horizontal alignment of railroad track in accordance with a wire reference system having a reference wire tautly extending along said track, said mechanism comprising frame means, the position of said frame means in use being referenced to the existing position of an adjacent section of the railroad track, pivot means mounted on said frame means, a needle indicator mounted on said pivot means to pivot about a horizontal axis generally parallel to the reference wire, a second indicator mounted on said needle indicator for generally vertical, sliding movement thereon, first index means arranged on said frame means to indicate in combination with said needle indicator the existing horizontal alignment of said adjacent section with reference to said reference wire, second index means to indicate in combination with said second indicator the existing grade of said adjacent section with reference to said reference wire wherein, during use of said mechanism, the positions of said needle indicator and second indicator are adjusted by said reference wire in contact with said needle indicator and second indicator.

2. An indicator mechanism according to claim 1 wherein said reference wire extends through an elongated slot in the bottom portion of said needle indicator, said slot extending vertically when said needle indicator is in a vertical position.

3. An indicator mechanism according to claim 1 wherein said second index means is arranged on said needle indicator.

4. An indicator mechnism according to claim 3 wherein said first index means comprises a scale on a plate mounted above said pivot means, which scale extends generally horizontally along an arc of a circle, the center of which is normally located above said reference wire when said railroad track is in proper horizontal alignment.

5. An indicator mechanism according to claim 1 wherein the position of said pivot means is horizontally adjustable on said frame means in order to compensate for curvature in the track being aligned.

6. An indicator mechanism according to claim 2 wherein said second indicator is slidable in said elongated slot and includes a pointer to indicate a grade reading on said second index means which extends along one side of said slot.

7. An indicator mechanism according to claim 1 wherein said second indicator has a shadow board mounted thereon and a photocell device is mounted on said needle indicator and wherein movement of said shadow board to a position which interrupts light being directed at a receiver of said photocell device causes an electrical signal to be transmitted, said signal indicating the position of said second indicator relative to said second index means.

8. An indicator mechanism according to claim 7 wherein said shadow board interrupts said light when said second indicator is at the zero position on said second index means.

9. In an apparatus for correcting the grade and horizontal alignment of railroad track, the combination of a reference wire tautly extending along a railroad track between front and rear anchor points and an indicator mechanism comprising frame means, the position of said frame means in use being referenced to the existing position of an adjacent section of the railroad track, pivot means mounted on said frame means, a needle indicator mounted on said pivot means to pivot about a horizontal axis generally parallel to the reference wire, a second indicator mounted on said needle indicator for generally vertical, sliding movement thereon, first index means arranged on said frame means to indicate in combination with said needle indicator the existing horizontal alignment of said adjacent section with reference to said reference wire, second index means to indicate in combination with said second indicator the existing grade of said adjacent section with reference to said reference wire wherein, during use of said mechanism, the positions of said needle indicator and second indicator are adjusted by said reference wire in contact with said needle indicator and second indicator.

10. An apparatus for correcting the grade and horizontal alignment of railroad track according to claim 9 wherein said reference wire extends through an elongated slot in the bottom portion of said needle indicator, said slot extending vertically when said needle indicator is in a vertical position.

11. An apparatus for correcting the grade and horizontal alignment of railroad track according to claim 10 including a railroad vehicle having means for adjusting the vertical and horizontal position of said adjacent section of track, said reference wire and needle indicator being mounted at one side of said vehicle.

* * * * *